United States Patent [19]

Wolf et al.

[11] B 3,994,773

[45] Nov. 30, 1976

[54] METHOD AND APPARATUS FOR DETECTING VERTICAL DISPLACEMENT OF AN UPPER SLICE LIP

[75] Inventors: Karl Wolf, Heidenheim-Schnaitheim; Dieter Egelhof, Heidenheim (Brenz), both of Germany

[73] Assignee: J. M. Voith GmbH, Heidenheim (Brenz), Germany

[22] Filed: Feb. 24, 1975

[21] Appl. No.: 552,629

[44] Published under the second Trial Voluntary Protest Program on March 23, 1976 as document No. B 552,629.

[30] Foreign Application Priority Data

Feb. 28, 1974 Germany ..... 2409521

[52] U.S. Cl. ..... 162/198; 162/259; 162/263; 162/347

[51] Int. Cl.[2] ..... D21F 1/06; D21F 7/06

[58] Field of Search ..... 162/198, 199, 212, 263, 162/272, 344, 347, 259

[56] References Cited

UNITED STATES PATENTS

| | | | |
|---|---|---|---|
| 3,463,701 | 8/1969 | Curtis | 162/347 |
| 3,645,843 | 2/1972 | Schmaeng | 162/347 |
| 3,738,910 | 6/1973 | De Noyer | 162/347 |

FOREIGN PATENTS OR APPLICATIONS

| | | | |
|---|---|---|---|
| 1,461,176 | 10/1969 | Germany | 162/347 |

*Primary Examiner*—S. Leon Bashore
*Assistant Examiner*—Richard V. Fischer
*Attorney, Agent, or Firm*—Melvin A. Crosby

[57] ABSTRACT

A headbox for a papermaking machine or the like in which material, such as supension, flows from the headbox between upper and lower lips and through a discharge slot defined by the lips to a wire or a like receiver. The upper lip is reinforced by a beam extending along the upper lip on top of the lip while a detector is provided for detecting deflection of the upper lip due to the forces exerted thereon by material flowing between the lips. The detector is arranged to emit signals in conformity with deflection of the upper lip and correcting influences can be initiated in conformity with the emitted signals to compensate for the aforementioned deflection. In particular, the detector includes an element stationary with the upper lip in about the center of the lateral length of the lip and another element which is stationarily mounted and which elements cooperate upon relative vertical movement therebetween to bring about the emitting of signals which represent a measure of the amount of deflection of the upper lip.

17 Claims, 15 Drawing Figures

Air or fluid pressure
Valve

II
11
10
10'
8
13
14'
14
14"
6
9
12
7
3
5
1
4
2
15
114'
114
114"
214'
214
214"
314'
314
314"
414'
414
414"
514'
514
514"

METHOD AND APPARATUS FOR DETECTING VERTICAL DISPLACEMENT OF AN UPPER SLICE LIP

The present invention relates to headboxes such as are employed in connection with paper machines and the like and, in particular, is concerned with a method and apparatus for controlling the discharge of material through the discharge slot thereof and which is defined by upper and lower lip members.

Headboxes of the nature with which the present invention is concerned are well known and are employed with, for example, papermaking machines. The headboxes for papermaking machines are supplied with a suspension of fibers in a watery vehicle and this material is flowed out from the headbox through a discharge slot to a receiving wire or the like and through the wire the watery vehicle drains leaving behind the fibers which form into a paper sheet.

With modern high speed papermaking machines, the suspension is quite often supplied under pressure and emerges from the discharge slot of the headbox at considerable speed. It is quite often the case that the discharge slot from the headbox is formed by a lower lip member extending laterally of the machine in a generally horizontal direction and an upper lip member above the lower lip member and generally parallel thereto. The lip members define therebetween the discharge slot for the headbox, and the material flows in the headbox longitudinally between the lip members and then out through the discharge slot.

Due to the aforementioned pressure on the fibrous suspension, the upper lip member tends to deflect upwardly, and this can result in the material supplied from the discharge slot being somewhat thicker in the central region than at the sides of the machine. This is, of course, undesirable because the suspension drains quite quickly and the resulting paper sheet will vary in thickness from side to side.

Still further, changes in temperature can occur, and this will also tend to cause deflection of the aforementioned upper lip.

It has been mentioned that modern machines operate at high speed, and it is sometimes the case that it may require several hours to bring a machine on stream and operating at the desired speed. During the time that the machine is being put on stream and brought up to speed, the conditions which bring about deflection of the upper lip member can change whereby any correcting influence exerted on the lip member at one time may be incorrect at a later time.

With the foregoing in mind, it will be evident that the principal objective of the present invention is the provision of a method and apparatus for substantially continuously exerting correcting influences on an upper lip member of the aforesaid nature or for developing signals which vary in conformity with the deflection of the upper lip member and which can, therefore, be employed for controlling correcting influences.

A headbox is known from Swiss Pat. No. 513,287 (U.S. Pat. No. 3,645,843) to provide a pressure cushion acting on one of the lips forming a discharge slot from a headbox for adjusting the width of the discharge slot. However, due to the variation in the deflecting influences that are exerted on the lip member forming the discharge slot, the subject of the Swiss patent is defective for correcting the deflection of the lip member under varying circumstances.

The West German Pat. No. 1,461,176, issued Oct. 9, 1969, proposes to transfer the bending forces exerted on the upper lip member, or on a supporting beam connected with the lip member, through a pressure cushion to a relieving beam which will, itself, become bent under the forces transferred thereto whereas the lip member remains substantially straight. In a construction according to the West German patent, the dimensions of the pressure cushion must be accurately adapted to the bending forces which it is to resist but while the machine is being put on stream, the bending forces change continuously and the construction of the West German patent referred to becomes defective because it does not compensate for such changes.

The West German patent referred to includes a pressure chamber which is operated with a pressure, the magnitude of which is selected for compensation of the bending load on the lip member in the course of normal operations. During the time that the machine is being put on stream, however, and which may require several hours, the pressure in the pressure chamber is too high so that the web being made tends to be too thin in the central region.

BRIEF SUMMARY OF THE INVENTION

According to the present invention, the problems referred to above have been solved and the tendency of the upper lip member defining the discharge slot to bend is accurately ascertained at all times so that corrective influences can be generated in accordance with the amount of the bending forces.

The solution according to the present invention consists of stationarily supporting a cable-like member in a substantially horizontal position above the upper lip member and arranging a detecting or measuring device between the laterally central region of the upper lip and the adjacent region of the cable-like member.

In one form which the invention takes, the measuring or detecting device consists of a first element stationarily mounted on the upper lip member in about the middle of the lateral width thereof. This element will move vertically in conformity with deflecting movements of the upper lip member. The cable-like member, on the other hand, is stationarily supported at horizontally spaced points near the vertical planes of the ends of the upper lip member and takes no part in the vertical deflecting movements of the upper lip member.

Thus, the cable-like member itself, or a second element carried thereby, can cooperate with the element connected to the upper lip member and, in this manner, a direct measurement of any movement of the upper lip member can be ascertained by signals emitted by the detecting or measuring device.

The upper lip member is provided with reinforcing beam means extending therealong on top and which beam means may comprise a first hollow beam resting directly on the top of the upper lip member and a second hollow beam superposed on the first beam with the interposition of a cushion element. The cushion element referred to may comprise a closed chamber to which fluid under pressure is supplied at a pressure which varies in conformity with the signals emitted by the detecting or measuring device.

Still further, the upper lip member may have vertical spindles distributed laterally thereof with lower ends engaging the top of the lip member near the discharge slot and with upper ends stationarily abutted, for example, by the reinforcing beam mounted on top of the upper lip member. The spindles are adjustable in length and the signals emitted by the detecting or measuring device can be employed for adjusting the spindles thereby to exert corrective influences on the upper lip member. The spindles could also be employed in the absence of the reinforcing beam member as well as in combination therewith.

The cable-like member may be weighted to maintain the reach thereof which pertains to the detecting or measuring device taut or a spring may be provided to hold the aforementioned reach of the cable-like member taut and with the spring, if desired, being adjustable to vary the tension exerted on the cable-like member.

In one form of the invention, the cable-like member is entrained over pulleys stationarily mounted near the ends of the upper lip member and weights are connected to the free ends of the cable-like member. In another form of the invention, the cable-like member is in the form of an endless loop and a weight is connected to the lower reach, thus, holding the upper reach of the loop extending between the pulleys taut.

The exact nature of the present invention and the objects and advantages thereof will become more apparent upon reference to the following detailed specification taken in connection with the accompanying drawings in which.

DETAILED DESCRIPTION OF THE INVENTION

Figures 1, 2, 6, 7, 8, 9, 10, 11, 12, 13, 14, 15:
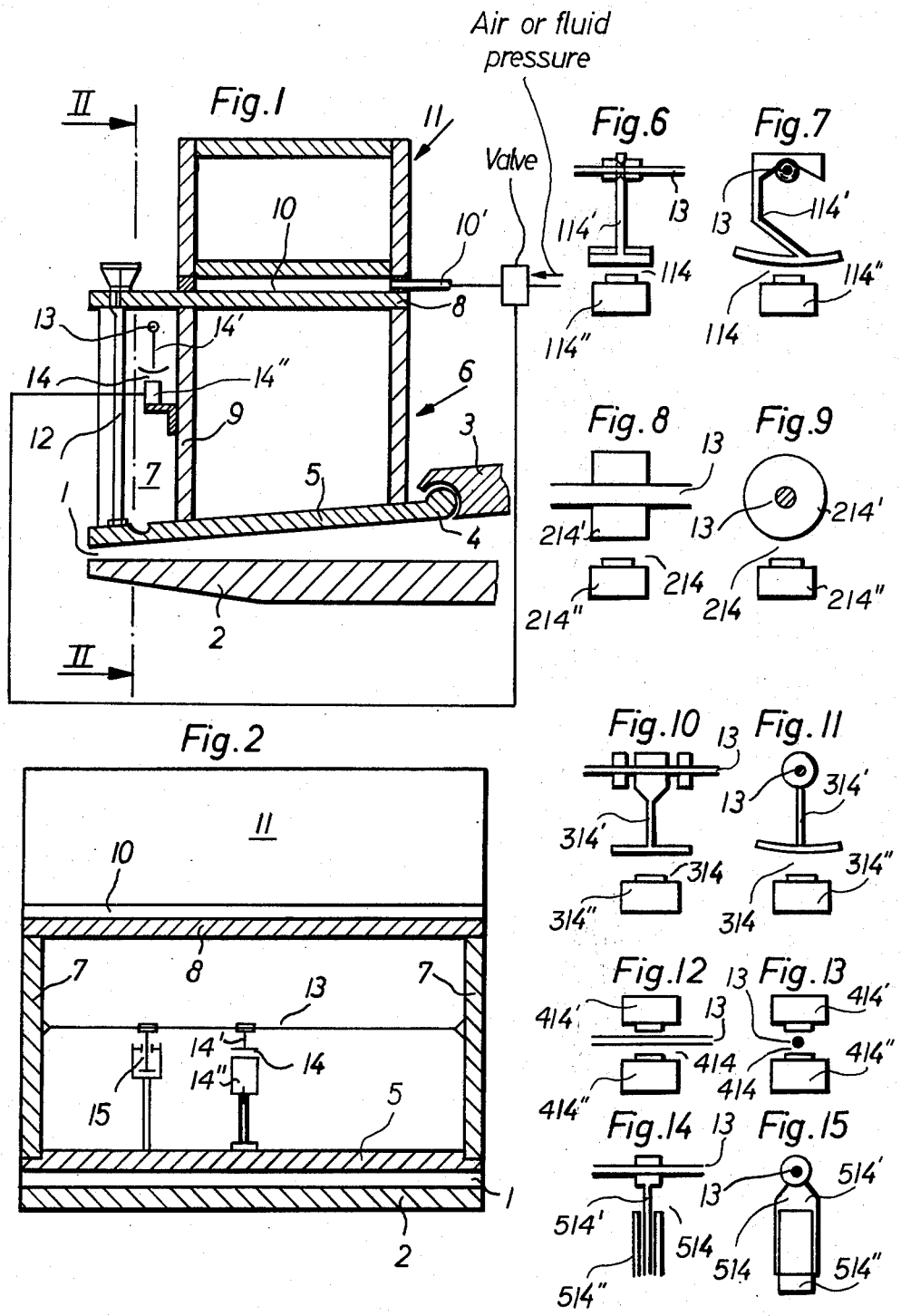
FIG. 1 is a vertical sectional view in the fore and aft direction through a headbox having a discharge slot defined between upper and lower lip members with an arrangement according to the present invention for detecting deflection of the upper lip member.
FIG. 2 is a transverse section indicated by line II—II on FIG. 1 and substantially foreshortened from side to side.
FIGS. 6, 8, 10, 12 and 14 are views schematically illustrating different arrangements of the detecting or measuring device with the cable-like member in the plane of the drawing.
FIGS. 7, 9, 11, 13 and 15 are side views of FIGS. 6, 8, 10, 12 and 14, respectively.

Referring to the drawings somewhat more in detail, a headbox, only a portion of which is shown in the form of a frontal wall 3 and a substantially rigid lower lip member 2, is provided to which suspension is supplied and which suspension may be under pressure within the headbox.

Pivotally connected as at 4 to the forward edge of frontal wall 3 is an upper lip member 5. At the free ends of lip members 2 and 5, there is defined the discharge slot 1 which extends transversely of the machine and from which the suspension flows to a receiving wire or the like.

Upper lip member 5 has connected to the upper side thereof a box beam 6 extending laterally across the width of the machine and having two end walls 7 which are elongated in a direction toward discharge slot 1 beyond frontal wall 9 of the box beam. The box beam, furthermore, has an upper wall 8 which is also elongated toward discharge slot 1 beyond frontal wall 9 of the beam.

Immediately above upper wall 9 and box beam 6 there is a confined space 10 representing a pressure cushion which is bounded on the bottom by the upper wall 8 and on the top is bounded by a relieving beam 11 which may also be constructed as a box beam. Advantageously, the beams 6 and 11 are fixedly interconnected only at the opposite ends so that upon variation of the pressure in chamber 10, as can be brought about by varying the pressure fluid supplied thereto via conduit 10', the beam 6 can be influenced to hold upper lip member 5 substantially flat from side to side while the bending forces exerted on lip member 5 are transferred to relieving beam 11 which is, in conformity with these bending forces, deflected upwardly.

Near the discharge end of upper lip member 5 there is arranged several adjustable spindles 12 distributed laterally along the machine width and bearing at the lower end on top of upper lip 5 and at the upper end bearing on upper wall 8 of box beam 6. These spindles are adjustable in length as by threaded means connected thereto and can be employed for exerting downward thrust on top of lip member 5 to compensate for any tendency of the lip member to deflect.

A particular feature of the present invention is to be found in connection with the cable-like member or rope 13 extending substantially horizontally across the machine adjacent frontal wall 9 of beam 6 and associated with which is a detecting or measuring device 14, preferably contact free. The measuring device 14, as will be seen in FIG. 1, may comprise an element 14' connected to the cable-like member and an element 14'' which is stationarily supported relative to a laterally central region of upper lip member 5 near discharge slot 1.

Since the box beam 6 rests directly on top of upper lip member 5, element 14'' can be connected to frontal wall 9 of box beam 6 because the frontal wall will move directly with the upper lip member 5 if the latter deflects. The detecting device 14, which can be any of several types, is arranged to emit signals in conformity with relative vertical movement between the elements thereof.

Since element 14' is stationarily supported and element 14'' is connected to the upper lip member so as to move therewith, it follows that the detecting or measuring device will accurately detect or measure deflecting movements of the upper lip member and will emit signals in conformity with the amount of said movement.

As will be seen in FIG. 2, the cable-like member 13 may be connected at the opposite ends to the forwardly projecting portions of end walls 7 of box beam 6 and which end walls 7 are disposed in vertical planes near the opposite ends of upper lip member 5.

It has been mentioned that the papermaking machine operates at high speed, and for this reason, vibration is apt to be encountered, and it has been found to be of advantage to damp vibrations which may be imparted to cable-like member 13 by interposing a vibration damping device 15 between the cable-like member and a suitable other point.

Figure 3:
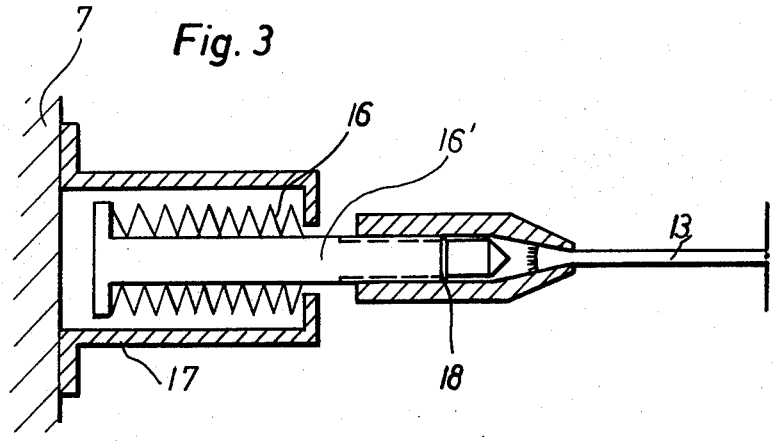
FIGS. 3, 4 and 5 show different arrangements for holding a cable-like member forming a part of the detecting device taut.

FIG. 2 shows the cable connected directly to end walls 7 of box beam 6. It will be evident that the cable should be held taut across the width of the machine in order to obtain reliable results from the measuring device. FIG. 3 shows how a spring retainer 17 could be mounted on one of the walls 7 with a compression spring 16 contained within the spring retainer and bearing thereon at one end.

The other end of the compression spring bears on a bolt 16' which has a threaded end protruding from spring retainer 17 and threadedly engaging an anchor member 18 which is connected to the adjacent end of cable-like member 13. Spring 16 will hold cable-like member 13 taut across the machine and adjustment of anchor member 18 will permit adjustment of the tension exerted on the cable member.

Figure 4:
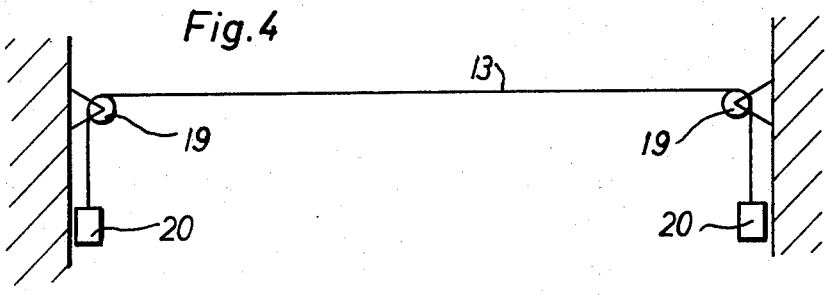

In FIG. 4, rollers 19 are mounted on the end walls 7 of the box beam and cable-like member 13 is entrained over the pulleys and with weight elements 20 connected to the free ends of the cable-like member. Weights 20 hold the cable-like member taut between the pulleys. It will, also, be apparent that one end of the cable in FIG. 4 could be fixed and to one of the end walls 7 of box beam 6 with the other end being entrained over a pulley and weighted as by a weight 20.

Figure 5:
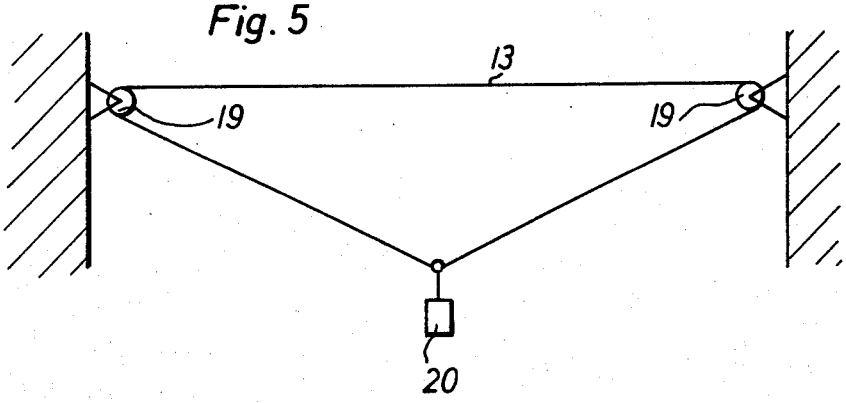

In FIG. 5, the cable-like member 13 is in the form of an endless loop with the upper reach thereof being that one which pertains to the detecting or measuring device. In this case, a weight 20 is connected to the lower reach of the cable-like member 13 and holds the upper reach taut.

FIGS. 6 to 15 show various detecting and measuring devices. These devices could be operated in any known manner known in connection with contact free detecting and measuring devices, such as electrically or magnetically or electro-optically. Electrical devices could, for example, operate inductively or on the basis of change in capacitance. Magnetic devices could operate by simple magnetic changes or devices such as differential transformers could be employed as a measuring device.

In the arrangement shown in FIGS. 6 and 7, the element 114' of detector 114 which is connected to the cable-like member 13 hangs thereon and is free to swing in the fore and aft direction but is elongated in the fore and aft direction in an arcuate manner so that swinging of element 114' will not change its relation to element 114'' with respect to signal generation.

In FIGS. 8 and 9, the element 214' of detector 214 is in the form of a cylindrical body carried by the cable-like member 13, and cooperates with element 214''.

In FIGS. 10 and 11, the element 314' of detector 314 is again swingably mounted on the cable-like member 13 and is so curved at the lower end that its relationship to element 314'' in the vertical direction does not change as element 314' swings.

FIGS. 12 and 13 show the element 414' of detector 414 associated with a further element 414'' in spaced opposed relation with cable-like member 13 extending therebetween. In this case, the detecting and measuring device could operate optically or the cable-like member could be formed of magnetic material and influence the two elements of the detecting means differentially as the detecting means move vertically relative to the cable-like member. In FIGS. 12 and 13, both of the elements are advantageously mounted on frontal wall 9 of box beam 6.

Finally, as to FIGS. 14 and 15, the element 514' of detector 514 carried by the cable-like member 13 may be partly coextensive in the vertical direction with the element 514'' mounted on frontal wall 9 of the beam 6. The degree of telescoping of the elements controls the emitting of signals emitted thereby.

The signals emitted by the detecting and measuring device can be employed in a known manner for adjusting the spindles 12 to compensate for deflections of the upper lip member or for adjusting the pressure in chamber 10, or both.

By the employment of the method and apparatus of the present invention, the upper lip member is maintained substantially free of deflection and the stream of material issuing from discharge opening 1 remains substantially uniform in thickness side to side of the machine under all conditions of operation and including the start-up period during which the machine is being brought on stream and coming up to full speed.

Modifications may be made within the scope of the appended claims.

What is claimed is:

1. A headbox for papermaking machine, or the like, comprising; generally horizontal upper and lower lips forming a laterally extending discharge slot therebetween, beam means engaging the said upper lip from above to reinforce the upper lip against bending forces exerted thereon during the flow of material from the headbox between said lips and out said discharge slot, and detecting means for detecting vertical deflections of said upper lip from a predetermined position thereof, said detecting means including at least one element stationarily supported by said upper lip near the laterally central region thereof, a flexible cable-like member extending parallel to said upper lip in the transverse direction and spaced from said one element, relative vertical movement between said cable-like member and said one element as brought about by changes in suspension flow between said lips causing said detecting means to emit signals in conformity with the amount of said relative movement, and support means stationarily mounted near the vertical planes of the opposite ends of said upper lip and supporting said cable-like member in a predetermined generally horizontal position.

2. A headbox according to claim 1 in which said detecting means comprises a second element carried by said cable-like member and in adjacent relation to said one element, relative vertical movement of said elements causing said detecting means to emit signals.

3. A headbox according to claim 1 which includes vertical spindle means having the lower ends engaging the top of said upper lip near said slot and the upper ends engaging said beam means, said spindle means being adjustable in length, and means for adjusting said spindle means in length in conformity with signals emitted by said detecting means.

4. A headbox according to claim 1 in which said beam means comprise superposed hollow beams extending laterally substantially the full width of the machine.

5. A headbox according to claim 4 which includes a fluid cushion interposed between said beams, means for subjecting said fluid cushion to internal pressure, and means for varying said pressure in conformity with signals emitted by said detecting means.

6. A headbox according to claim 1 in which said upper lip and the beam means are pivotally supported in a region parallel to said slot and spaced therefrom toward the headbox.

7. A headbox according to claim 1 in which one end of said cable-like member is stationarily supported, and spring means having one end stationarily supported and the other end engaging the other end of said cable-like member and holding said cable-like member taut.

8. A headbox according to claim 7 which includes means for adjusting the degree of tension exerted on the cable-like member by said spring means.

9. A headbox according to claim 1 in which said support means comprise rollers over which said cable-like member is entrained, and weight means connected to said cable-like member to hold the cable-like member taut between said rollers.

10. A headbox according to claim 9 in which said weight means comprises a weight connected to each end of the cable-like member.

11. A headbox according to claim 1 in which said support means comprise rollers over which said cable-like member is entrained, said cable-like member being in the form of an endless loop having an upper reach extending horizontally between said rollers, and weight means on the lower reach of the loop holding said upper reach taut.

12. A headbox according to claim 1 in which said beam means extends substantially the full width of the machine and said support means are connected to said beam means near the ends thereof.

13. A headbox according to claim 1 which includes vibration damping means connected to said cable-like member to inhibit vibrations thereof.

14. A headbox according to claim 2 in which at least one of said elements is elongated in a direction parallel to said slot to eliminate variations of the signals emitted by said detecting means due to relative movement between said elements in the horizontal direction.

15. In a papermaking method in which suspension flows from a headbox between horizontal upper and lower lips and through a horizontal discharge slot formed by the lips, that method of detecting vertical deflection of the upper lip in the laterally central region as caused by changes in the flow of suspension between the lips thereof by detecting means having first and second elements and which elements cause the detecting means to emit signals in conformity with relative vertical displacement of said elements, which comprises; supporting a first of said elements on the said central region of the upper lip, supporting the second of said elements stationarily on the end regions of the upper lip, said second element extending above said central region of the upper lip and in cooperating relation with the first element whereby the signals emitted by the detecting means are a measure of the vertical deflection of the central region of the upper lip, and adjusting the position of at least the central region of the upper lip in conformity with the signals emitted by said detector to effect said compensation.

16. The method according to claim 15 which includes connecting a hollow beam to the upper side of the upper lip extending substantially the full length of the upper lip and parallel to the slot, and adjusting the pressure in the beam in conformity with the signals emitted by the detecting means to effect said compensation.

17. The method according to claim 15 which includes engaging laterally spaced points along the top of the upper lip near the slot by the lower ends of adjustable length vertical spindles having stationarily supported upper ends, and adjusting the length of said spindles in conformity with the signals emitted by the detecting means to effect said compensation.

* * * * *